US005557304A

United States Patent [19]

Stortz

[11] Patent Number: 5,557,304

[45] Date of Patent: Sep. 17, 1996

[54] SPOT SIZE MODULATABLE INK JET PRINTHEAD

[75] Inventor: James L. Stortz, Spring, Tex.

[73] Assignee: Compaq Computer Corporation, Houston, Tex.

[21] Appl. No.: 60,440

[22] Filed: May 10, 1993

[51] Int. Cl.[6] ..... B41J 2/205

[52] U.S. Cl. ..... 347/15; 347/9; 347/11

[58] Field of Search ..... 347/5, 9, 10, 11, 347/12, 15, 54, 68, 69; 358/298

[56] References Cited

U.S. PATENT DOCUMENTS

| | | | |
|---|---|---|---|
| 3,857,049 | 12/1974 | Zoltan | 310/8.1 |
| 4,503,444 | 3/1985 | Tacklind | 347/11 |
| 4,513,299 | 4/1985 | Lee et al. | 347/15 |
| 4,523,200 | 6/1985 | Howkins | 347/11 |
| 4,523,201 | 6/1985 | Liker | 347/11 |
| 4,536,097 | 8/1985 | Nilsson | 400/126 |
| 4,561,025 | 12/1985 | Tsuzuki | 347/15 X |
| 4,563,689 | 1/1986 | Murakami et al. | 347/11 |
| 4,584,590 | 4/1986 | Fischbeck et al. | 347/69 |
| 4,675,693 | 6/1987 | Yano et al. | 347/20 |
| 4,680,645 | 7/1987 | Dispoto et al. | 347/15 |
| 4,743,924 | 5/1988 | Scardovi | 347/10 |
| 4,752,790 | 6/1988 | Scardovi | 347/10 |
| 4,825,227 | 4/1989 | Fischbeck et al. | 347/69 |
| 4,879,568 | 11/1989 | Bartky et al. | 347/69 |
| 4,887,100 | 12/1989 | Michaelis et al. | 347/69 |
| 4,931,810 | 6/1990 | Iwata et al. | 347/100 |
| 4,963,882 | 10/1990 | Hickman | 347/41 |
| 5,016,028 | 5/1991 | Temple | 347/69 |
| 5,138,333 | 8/1992 | Bartky et al. | 347/11 |
| 5,170,177 | 12/1992 | Stanley et al. | 347/11 |
| 5,426,455 | 6/1995 | Williamson et al. | 347/10 |

FOREIGN PATENT DOCUMENTS

| | | | |
|---|---|---|---|
| 347257 | 6/1989 | European Pat. Off. . | |
| 0364136 | 4/1990 | European Pat. Off. . | |
| 437106 | 12/1990 | European Pat. Off. . | |
| 0402172 | 12/1990 | European Pat. Off. . | |
| 0485241 | 5/1992 | European Pat. Off. . | |
| 528648 | 8/1992 | European Pat. Off. . | |
| 570167 | 5/1993 | European Pat. Off. . | |
| 3820082 | 12/1988 | Germany . | |
| 55-65568 | 5/1980 | Japan | 347/10 |

OTHER PUBLICATIONS

Wallace, David B., entitled "A Method of Characteristic Model of a Drop–on–Demand Ink–Jet Device Using an Integral Method Drop Formation Model", *89–WA/FE–4* (1989).

Tsao, C. S., entitled "Drop–on–Demand Ink Jet Nozzle Array with Two Nozzles/Piezoelectric Crystal", *IBM Technical Disclosure Bulletin*, vol. 23 No. 10 (Mar. 1981).

Patent Abstracts of Japan, vol. 6, No. 263, Dec. 1982.

*Primary Examiner*—John E. Barlow, Jr.

*Attorney, Agent, or Firm*—Vinson & Elkins L.L.P.

[57] ABSTRACT

A spot size modulatable, drop-on-demand type ink jet printhead for producing grey-scale images on a substrate. The ink jet printhead includes a main body portion having an ink-carrying channel extending therethrough and a piezoelectric actuator coupled to the ink-carrying channel. A spot size for droplets to form when striking the substrate after ejection from the ink-carrying channel is selected and a look-up table translates the selected spot size into a time period during which a voltage pulse is to be applied to the piezoelectric actuator by an associated switching structure to cause the ejection of a droplet of ink capable of forming a spot having the desired size. An associated control circuit causes the switching structure to initiate application of the voltage waveform, determines whether the voltage waveform has been applied to the piezoelectric actuator for the time period and terminates application of the voltage waveform upon expiration of the time period. The control circuit includes a sequencer which selectively asserts or deasserts at least one control signal to the switching structure, a timer which instructs the sequencer to initiate application of the voltage waveform and determines time elapsed since initiating application, and a comparator which compares the time period produced by the look-up table and the elapsed time determined by the timer.

7 Claims, 3 Drawing Sheets

SPOT SIZE MODULATABLE INK JET PRINTHEAD

CROSS REFERENCE TO RELATED APPLICATIONS

This application is related to the following co-pending patent applications:

| Serial No. | First Named Inventor | Title |
|---|---|---|
| 08/060,295 | Stortz | Switched Digital Drive System For An Ink Jet Printhead |
| 08/060,296 | Stortz | Differential Drive System For An Ink Jet Printhead |
| 08/060,294 | Wallace | Droplet Volume Modulation Techniques For A Ink Jet Printheads |
| 08/060,297 | Stortz | Dual Element Switched Digital Drive System For An Ink Jet Printhead |
| U.S. Pat. No. 5,426,455 | Williamson | Three Element Switched Digital Drive System For An Ink Jet Printhead |

All of the above listed applications were filed on even date herewith, assigned to the Assignee of the present invention, and hereby incorporated by reference as if reproduced in their entirety.

BACKGROUND OF THE INVENTION

1. Field of the Invention

The present invention generally relates to ink jet printhead apparatus and, more particularly, to a drop-on-demand type ink jet printhead capable of producing gray scale images using either pulse width or voltage modulation to regulate the size of spots formed by droplets ejected from ink-carrying channels of the ink jet printhead 2. Description of Related Art Ink jet printing devices use the ejection of tiny droplets of ink to produce an image. The devices produce highly reproducible and controllable droplets of ink, such that an ejected droplet may be precisely directed to a location specified by digitally stored image data for deposition thereat. Most ink jet printing devices commercially available may be generally classified as either a "continuous jet" type ink jet printing device where droplets are continuously ejected from the printhead and either directed to or away from a substrate, for example, a sheet of paper, depending on the desired image to be produced or as a "drop-on-demand" type ink jet printing device where droplets are ejected from the printhead in response to a specific command related to the image to be produced and all such ejected droplets are directed to the substrate for deposition.

Many drop-on-demand type ink jet printheads utilize electromechanically induced pressure waves to produce the desired droplets of ink. In one representative configuration thereof, a drop-on-demand type ink jet printhead has a horizontally spaced parallel array of internal ink-carrying channels. These internal channels are covered at their front ends by a plate member through which a spaced series of small ink discharge orifices are formed. Each channel opens outwardly through a different one of the spaced orifices. Within such a printhead, a volumetric change in fluid contained in the internal channels is induced by the application of a voltage pulse to a piezoelectric material which is directly or indirectly coupled to the fluid. This volumetric change causes pressure/velocity transients to occur in the fluid and these are directed so as to force a small, fixed quantity of ink, in droplet form, outwardly through the discharge orifice at a fixed velocity. The droplet strikes the paper at a specified location related to the image being produced and forms an ink "spot" having a diameter directly related to the volume of the ejected droplet.

Due to their ability to produce a spot at any location on a sheet of paper, ink jet and other non-impact printers have long been contemplated as being particularly well suited to the production of continuous and half tone images. However, the ability of ink jet printers to produce continuous and half tone images has been quite limited due to the fact that most ink jet printheads can only produce droplets having both a fixed volume and a fixed velocity. As a result, ink spots produced by such droplets striking a sheet of paper are of a fixed size, typically in the range of 120 μm to 150 μm, and the same intensity. Additionally, all ink jet printheads use a fixed resolution, typically 300–400 dpi (or "dots per inch") or lower, to place droplets on a sheet of paper. In contrast, a typical high quality half tone image produced using offset printing techniques uses variable sized spots at resolutions of up to 240 dots per inch.

Due to the aforementioned limitations, ink jet printheads have heretofore utilized spot density, as opposed to spot size, when attempting to produce a gray scale image. To do so, the ink jet printhead creates various shades of gray by varying the density of the fixed size ink spots. Darker shades are created by increasing spot density and lighter shades are created by reducing spot density. Producing a gray scale image in this manner, however, reduces the spacial resolution of the printer, thereby limiting its ability to produce finely detailed images. Furthermore, the more levels added to the gray scale, the greater the resultant degradation of the printer's spacial resolution. A second proposed solution has been to direct multiple droplets at a single location on the sheet of paper to form variably sized spots. While such a method can produce the variably sized spots necessary to produce a gray scale image, such a technique tends to reduce the operating speed of the printer to an unacceptably low level. Furthermore, this technique may also produce elongated or elliptical dot patterns.

It can be readily seen from the foregoing that it would be desirable to provide an improved drop-on-demand type ink jet printhead configured such that the size of ink spots produced thereby is readily modulatable to produce a gray scale. It is, therefore, an object of the present invention to provide such an improved drop-on-demand type ink jet printhead.

SUMMARY OF THE INVENTION

In one embodiment, the present invention is of a spot size modulatable, drop-on-demand type ink jet printhead for producing gray-scale images on a substrate. The ink jet printhead includes a main body portion having an ink-carrying channel extending therethrough, means for selecting a spot size for droplets to be ejected from the ink-carrying channel, and means for ejecting, from the ink-carrying channel, droplets of ink having various volumes such that the ejected droplets, when striking a substrate positioned in the path thereof, will form a spot having the selected spot size. Preferably, the ejection means will be a piezoelectric actuator acoustically coupled to the ink-carrying channel and means for applying a selected voltage to the piezoelectric actuator for a selected period of time to cause a deflection of the piezoelectric actuator. In turn, the deflection of the piezoelectric actuator generates a pressure wave in the channel which causes the ejection of a droplet of ink capable of forming a spot having the selected spot size upon striking the substrate.

In alternate aspects of this embodiment of the invention, the selected voltage application means may further comprise means for modifying the produced spot size by varying a time period during which the voltage pulse is applied across the piezoelectric actuator or means for modifying the produced spot size by varying the magnitude of the selected voltage applied to the piezoelectric actuator for the selected period of time. The time period during which the voltage pulse is applied may be varied to produce at least a two fold variation in the selected spot density and may extend between 3 and 30 seconds. On the other hand, the magnitude of the selected voltage may be varied between 10 and 40 volts. Alternately, the voltage application means may be configured to include means for applying a first voltage having first magnitude and polarity for a first period of time and means for applying a second voltage having the first magnitude and a second polarity opposite to the first polarity for a second period of time approximately equal to the first period of time. In this aspect, the magnitude of the first voltage may be varied between 10 and 40 volts and the magnitude of the second voltage may be varied between −10 and −40 volts. In another aspect of this embodiment of the invention, the spot size selection means further includes means for translating the selected spot size into a time period during which the selected voltage is applied to the piezoelectric actuator.

In another embodiment, the present invention is of a spot size modulatable, drop-on-demand type ink jet printhead for producing gray-scale images on a substrate. The ink jet printhead includes a main body portion having an ink-carrying channel extending therethrough and a piezoelectric actuator acoustically coupled to the ink-carrying channel. Electrically connected with the piezoelectric actuator is a switching structure for selectively applying a voltage waveform thereto. By applying the voltage waveform to the piezoelectric actuator, the actuator deflects in a manner which produces a pressure wave in the ink-carrying channel capable of ejecting a droplet of ink therefrom. The ink-jet printhead further includes means for selecting a spot size for droplets ejected from the ink-carrying channel to form when striking the substrate and a look-up table for translating the selected spot size into a time period during which the voltage waveform is to be applied to the piezoelectric actuator. An associated control circuit causes the switching circuit to initiate application of the voltage waveform to the piezoelectric actuator, determines whether the voltage waveform has been applied to the piezoelectric actuator for the selected time period and terminates application of the voltage waveform to the piezoelectric actuator upon expiration of the selected time period.

In one aspect thereof, the control circuit includes sequencer means for selectively asserting or deasserting at least one control signal which is output to the switching structure to cause the switching structure to apply the voltage waveform to the piezoelectric actuator, timer means for instructing the sequencer means to initiate application of the voltage waveform and for determining time elapsed since initiating application of the voltage waveform, and comparator means for comparing the time period produced by the look-up table and the elapsed time determined by the timer means and instructing the sequencer means to deassert asserted control signals when the voltage waveform has been applied for the selected time period. In another aspect thereof, the switching structure is comprised of a positive voltage source, a negative voltage source, and means for selectively propagating a positive voltage pulse from the positive voltage source or a negative voltage pulse from the negative voltage source to the piezoelectric actuator.

In yet another embodiment, the present invention is of a spot size modulatable, drop-on-demand type ink jet printhead for producing gray-scale images on a substrate. The ink jet printhead includes a main body portion having an ink-carrying channel extending therethrough and a piezoelectric actuator acoustically coupled to the ink-carrying channel. Electrically coupled with the piezoelectric actuator is a switching structure for selectively applying a voltage waveform thereto. By applying the voltage waveform to the piezoelectric actuator, the actuator deflects in a manner which produces a pressure wave in the ink-carrying channel capable of ejecting a droplet of ink therefrom. The ink jet printhead further includes means for selecting a spot size for which droplets ejected from the ink-carrying channel are to form when striking the substrate and means for translating the selected spot size into a voltage pulse sequence which, when applied to the piezoelectric actuator by the switching structure, ejects a droplet of ink which forms an ink spot having the selected spot size. In alternate aspects thereof, the translating means may be configured to included means for selecting a magnitude for the voltage pulse sequence such that, upon application to the piezoelectric actuator, the voltage pulse sequence will cause the ejection of the droplet of ink capable of forming the ink spot having the selected spot size or means for selecting a pulse duration for the voltage pulse sequence such that, upon application to the piezoelectric actuator, the voltage pulse sequence will cause the ejection of the droplet of ink capable of forming the ink spot having the selected spot size.

DETAILED DESCRIPTION

Figure 1:
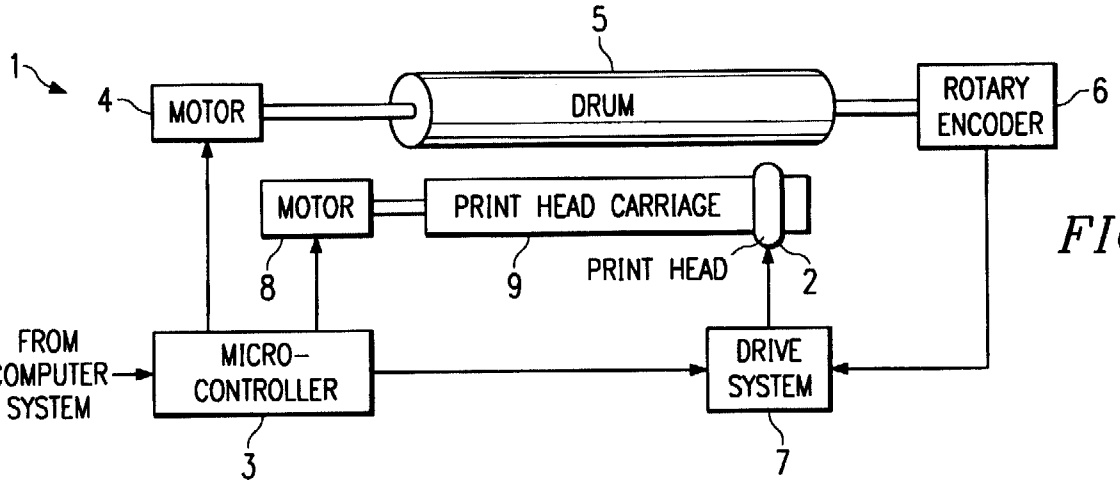
FIG. 1 is a schematic illustration of a drop-on-demand type ink jet printer incorporating therein a specially designed spot size modulatable ink jet printhead constructed in accordance with the teachings of the present invention.

Referring now to the drawing where like reference numerals designate the same or similar elements throughout the several views, in FIG. 1, an ink jet printer 1 incorporating therein a specially designed spot size modulatable drop-on-demand ink jet printhead 2 constructed in accordance with the teachings of the present invention may now be seen. The ink jet printer 1 includes a microcontroller 3 which controls the overall operation of the printer and, more specifically, the forming of an image on a substrate, for example, a sheet of paper. As would be well understood by one skilled in the art, an ink jet printer includes a plurality of ink-carrying channels which are selectively activated to cause the ejection of a droplet of ink therefrom. The ejected droplets strike the sheet of paper at specified locations to form the desired image on the sheet of paper.

For example, if the microcontroller 3 was instructed by a computer system (not shown) associated therewith to form a selected image at a specified location on a sheet of paper, the microcontroller 3 would instruct drum motor 4 to rotate paper drum 5 to advance paper stock (not shown) within the ink jet printer 1 such that the appropriate line at which the image was to be formed was positioned such that an ink droplet or droplets selectively ejected by the printhead 2 would strike the paper stock along the line. The microcontroller 3 would also instruct printhead carriage motor 8 to shuttle printhead carriage 9 such that the printhead 2 carried thereby is positioned along the selected line such that a droplet or droplets of ink ejected by the printhead 2 would strike the paper stock at the specified location or locations. Finally, the microcontroller 3 would provide clock and print control signals to drive system 7 which, together with positional information regarding the paper stock provided by rotary encoder 6, would indicate which ink-carrying channels of the ink jet printhead should be fired to form the desired image on the paper stock. The drive system 7 would then issue actuation signals to each of the selected ink-carrying channel or channels of the printhead 2 to cause the ejection of a droplet or droplets of ink therefrom to form the desired image at the selected location. While in the embodiment of the invention illustrated in FIG. 1, the drive system 7 is remotely positioned relative to the printhead 2, it is equally contemplated that the drive system 7 may be positioned on the printhead 2 itself in the manner illustrated in FIG. 2 below.

Figure 2:
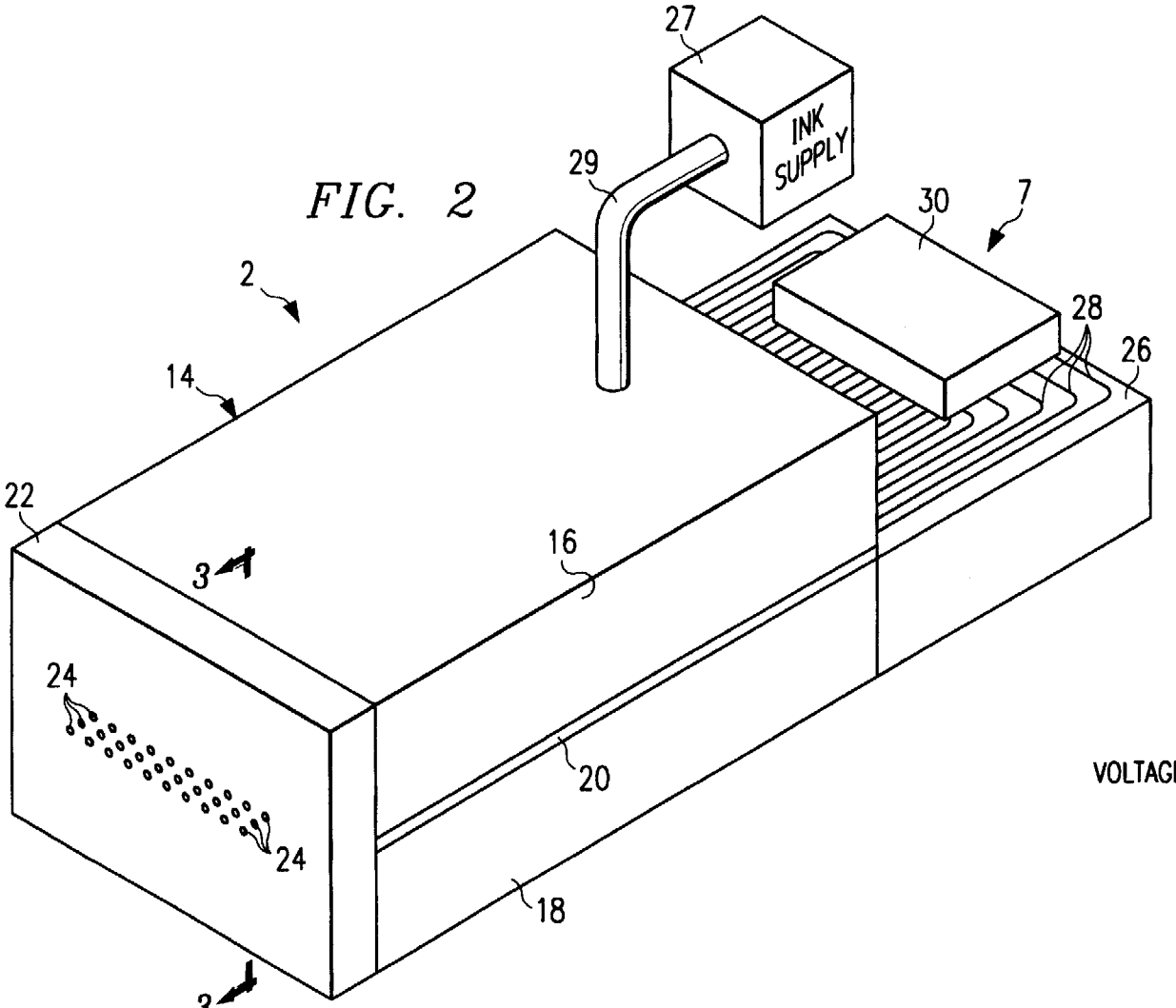
FIG. 2 is a perspective view of the ink jet printhead of FIG. 1.
Figure 3:
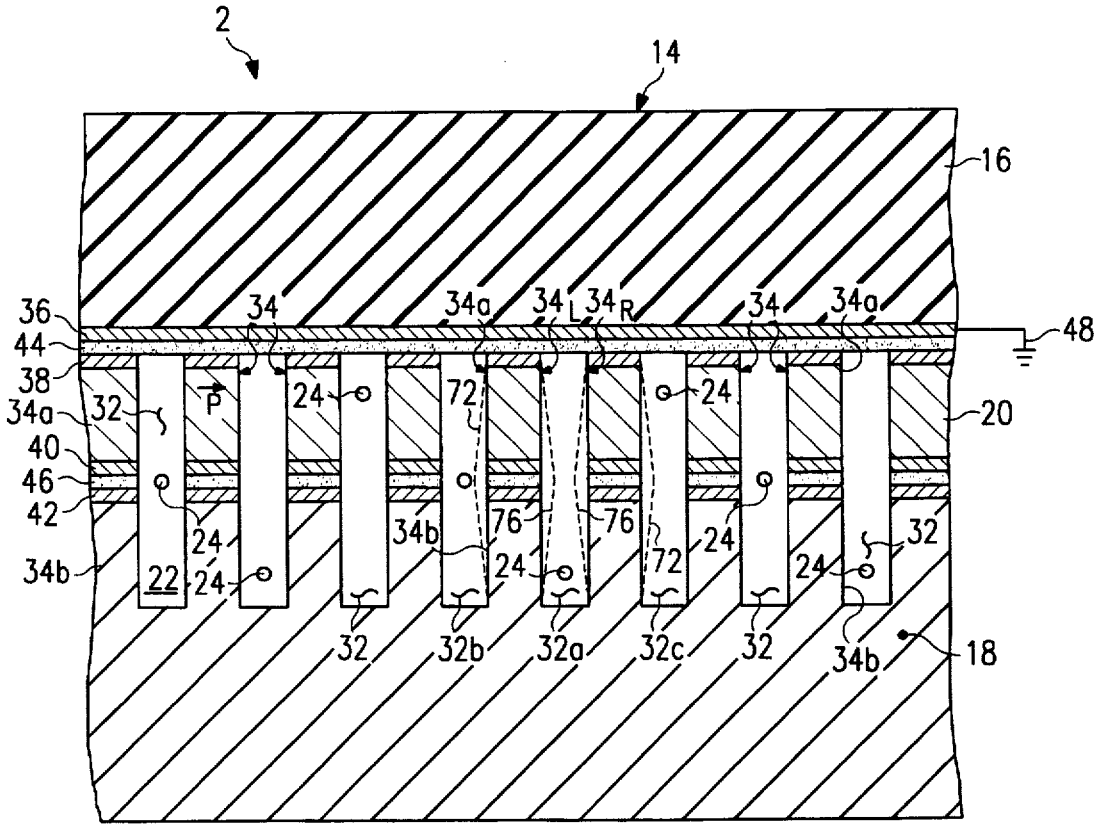
FIG. 3 is an enlarged scale partial cross-sectional view through the ink jet printhead taken along line 3—3 of FIG. 2 and illustrating a plurality of piezoelectrically actuated ink-carrying channels suitable for ejecting spot size modulatable droplets of ink therefrom.

Referring next to FIGS. 2 and 3, the ink jet printhead 2 will now be described in greater detail. The ink jet printhead 2 has a body 14 having upper and lower rectangular portions 16 and 18, with an intermediate rectangular body portion 20 secured between the upper and lower portions 16 and 18 in the indicated aligned relationship therewith. A front end section of the body 14 is defined by an orifice plate member 22 having a spaced series of small ink discharge orifices 24 extending rearwardly therethrough. As shown, the orifices 24 are arranged in horizontally sloped rows of three orifices each.

In a left-to-right direction as viewed in FIG. 2, the printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller portion 30 of the drive system 7 mounted on the surface 26 near the rear end of the body portion 18.

Referring now to FIG. 3, a plurality of vertical grooves of predetermined width and depth are formed in the printhead body portions 18 and 20 to define within the printhead body 14 a spaced, parallel series of internal ink receiving channels 32 that longitudinally extend rearwardly from the orifice plate 22 and open at their front ends outwardly through the orifices 24. The channels 32 are laterally bounded along their lengths by opposed pairs of a series of internal actuation sidewall sections 34 of the printhead body.

Sidewall sections 34 have upper parts 34*a* defined by horizontally separated vertical sections of the body portion 20, and lower parts 34*b* defined by horizontally separated sections of the body portion 18. The underside of the body portion 16, the top and bottom sides of the actuation sidewall section parts 34*a*, and the top sides of the actuation sidewall section parts 34*b* are respectively coated with electrically conductive metal layers 36, 38,40 and 42.

Body portions 16 and 20 are secured to one another by a layer of electrically conductive adhesive material 44 positioned between the metal layers 36 and 38, and the upper and lower actuator parts 34*a* and 34*b* are intersecured by layers of electrically conductive material 46 positioned between the metal layers 40 and 42. The metal layer 36 on the underside of the upper printhead body portion 16 is connected to ground 48. Accordingly, the top sides of the upper actuator parts 34*a* are electrically coupled to one another and to ground 48 via the metal layers 38, the conductive adhesive layer 44 and the metal layer 36.

Each of the channels 32 is filled with ink received from a suitable ink supply reservoir 27 (see FIG. 2) connected to the channels via an ink delivery conduit 29 connected to an ink supply manifold (not shown) disposed within the printhead body 14 and coupled to rear end portions of the internal channels 32. In a manner subsequently described, each horizontally opposed pair of the sidewall actuators 34 is piezoelectrically deflectable into and out of their associated channel 32, under the control of the drive system 7, to force ink (in droplet form) outwardly through the orifice 24 associated with the actuated channel.

Figure 4:
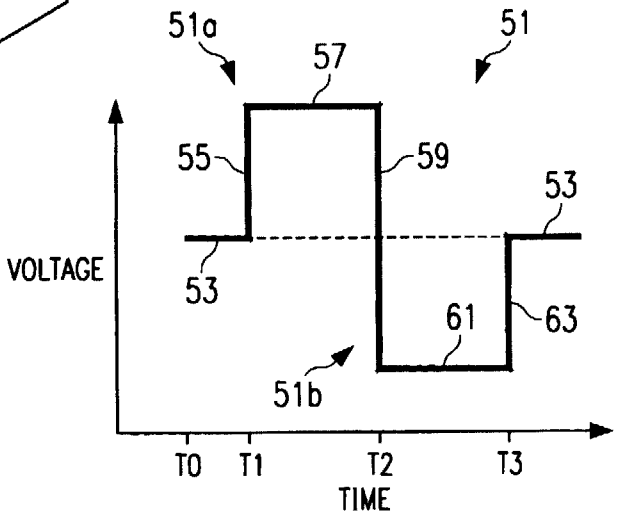
FIG. 4 is a schematic illustration of a voltage waveform suitable for application to the piezoelectrically actuated ink-carrying channels of FIG. 3 to cause the ejection of spot size modulatable droplets of ink therefrom.

Referring next to FIG. 4, the voltage waveform to be applied to a horizontally opposed pair of sidewall actuators 34 to force the ejection of a droplet of ink out of their associated channel 32 will now be described in greater detail. The voltage waveform 51, also referred to as an "echo pulse" waveform, includes primary and echo portions 51*a*, 51*b* which generate a pressure wave in an ink-carrying channel of the ink jet printhead 2 to cause the ejection of a droplet of ink, the volume of which may be readily modulated, in a manner more fully described below. In turn, when striking a sheet of paper, the modulatable volume droplets of ink produce modulatable size spots capable of producing a gray scale image.

From a rest state 53, during which a rest state voltage is applied across a piezoelectric actuator 34 and the actuator remains in a undeflected rest position, the voltage waveform 53 begins a first rapid rise 55 at time $T_1$ to a first or peak voltage to be applied across the piezoelectric actuator 34. The first rapid rise 55 in the voltage waveform 53 causes the piezoelectric actuator 34 to move to a first, outwardly deflected position, thereby producing an expansive pressure wave that begins to propagate both forwardly and rearwardly through an ink-carrying channel 32 partially defined thereby.

Once reaching the peak value, the voltage waveform 53 enters a primary dwell state 57 which extends from time $T_1$ to time $T_2$. During the primary dwell state 57, the voltage is held constant at the first value to hold the piezoelectric actuator 34 in the deflected position. While the voltage waveform 51 is held in the dwell state 57, the rearwardly propagating negative pressure wave will have deflected off the back wall of the printhead 2 and propagated forwardly within the channel 32 to its origination point. When the forwardly propagating reflected pressure wave reaches its origination point at time $T_2$, the voltage waveform 51 begins a rapid fall 59 during which the voltage drops below the rest voltage (thereby ending the primary portion 51*a* and beginning the echo portion 51*b* of the voltage waveform 51) to a second, lower value. During the fall 59, the voltage applied across the piezoelectric actuator 34 drops to the second value, thereby causing the piezoelectric actuator 34 to move, from the first, outwardly deflected position, past the rest position, and into a second, inwardly deflected position which compresses the channel 32. By compressing the channel 32, the piezoelectric actuator 34 imparts a positive pressure wave into the channel which reinforces the forwardly propagating, reflected pressure wave.

Once reaching the second, lower value, the voltage waveform 51 enters an echo dwell state 61 which extends from time $T_2$ to time $T_3$. During this state, the voltage is held constant at the second value to hold the piezoelectric actuator 34 in the second, channel compressing, deflected position. While the voltage waveform 51 is held in the echo dwell state 61, the forwardly propagating reinforced pressure wave will propagate towards the orifice 24. At time $T_3$, the voltage waveform 51 will begin a second rapid rise 63 which will return the voltage waveform 51 to the rest state 53, thereby ending the echo portion 51*b* of the voltage waveform 51. The piezoelectric actuator 34 will move from the second, channel compressing, deflected position to the rest position, thereby imparting a negative pressure wave into the channel 32. This negative pressure wave acts as an active pull-up which prematurely terminates the droplet formation process by the forwardly propagating reinforced pressure pulse. Having returned to the rest state, the voltage waveform 51 remains at this state to allow the pressure pulse within the channel 34 to dissipate over time. In an exemplary embodiment of the invention, the rest, first and second voltages may be 0, +20 and −20 volts, respectively, and the dwell and echo dwell times may both be 20 μsec. It is specifically contemplated, however, that numerous other values may be used for the rest, first and second voltages without departing from the scope of the present invention.

In an alternate embodiment of the invention not illustrated in the drawing, it is contemplated that the voltage waveform 51 may be an analog waveform rather than the digital waveform illustrated in FIG. 4, for example, by replacing the digital switching structure disclosed herein and more fully described below with an analog switching structure. While the duration of, and voltage magnitude during, the first rest state 53, the primary dwell state 57 and the echo dwell state 61 would remain essentially the same in this alternate embodiment of the invention, the first rapid rise 55, the rapid fall 59 and the second rapid rise 63 would have an elongated duration rather than the nearly instantaneous durations illustrated in FIG. 4. For example, the first rapid rise 55, the rapid fall 59 and the second rapid rise 63 may have durations of about 5 μsecond.

In yet another alternate embodiment of the invention not illustrated in FIG. 4, the voltage waveform may consist of only the primary portion 51*a* of the illustrated voltage waveform 51. More specifically, from the rest state 53, the voltage waveform may undergo a rapid rise at time $T_1$ to dwell state 57 and, at time $T_2$, undergo a rapid fall back to the rest state 53. As before, 20 μsecond would be suitable for the duration of the dwell state 57 and, also as before, either analog or digital switching structures may be used to produce the voltage waveform. While lacking the reinforcing pressure pulse produced by the echo portion 51*b* of the voltage waveform 51, it is contemplated that this alternate configuration of the voltage waveform would be equally suitable for ejecting volume modulatable droplets of ink provided that the primary pressure pulse is sufficiently strong to cause the ejection of the droplet of ink from the actuated channel.

Figure 5:
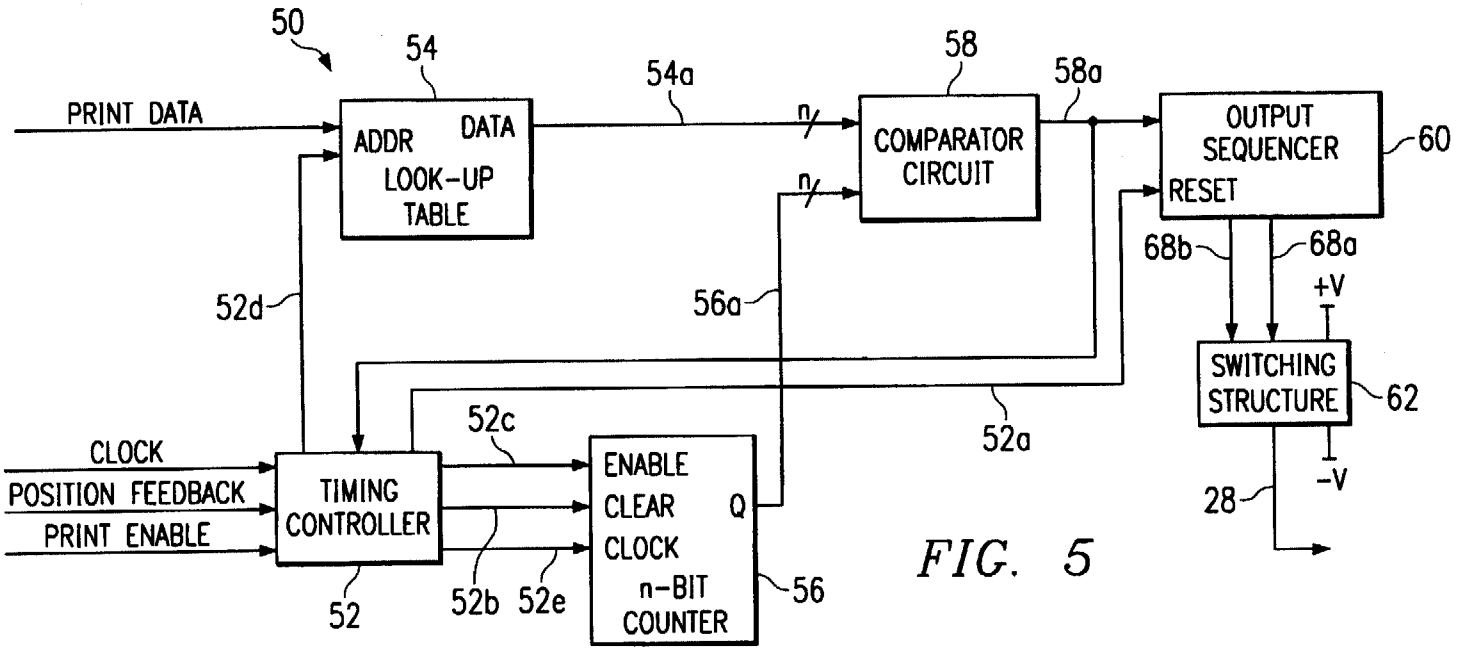
FIG. 5 is an expanded block diagram of the controller portion of the drive system of FIGS. 1 and 2.

Referring next to FIG. 5, the drive system 7 will now be described in greater detail. The drive system 7 includes a plurality of switching structures 62, each controlled by a corresponding control circuit 50 to be more fully described below. Each of the switching structures 62 is electrically connected to one of the leads 28 to actuate a sidewall actuator 34 of the ink jet printhead 2 such that, when a switching structure 62 generates a voltage pulse, either of a positive or negative polarity, the generated voltage pulse will cause the sidewall actuator 34 electrically associated therewith to deflect into a channel 32 partially defined by the sidewall actuator 34. It is contemplated that each switching structure 62 should preferably be configured as a two element switching structure identical to that disclosed in copending U.S. patent application Ser. No. 08/060,297, entitled "Dual Element Switched Digital Drive System For An Ink Jet Printhead" and previously incorporated by reference as if reproduced in its entirety. Accordingly, the output sequencer 60 provides two control lines 68*a*, 68*b* to the corresponding switching structure 62. When actuated by the output sequencer 60, the control lines 68*a*, 68*b* drive the output of the switching structure 62 to a positive or negative voltage, respectively. It is further contemplated that the switching structure 62 may be alternately configured as a three element switching structure identical to that disclosed in copending U.S. Pat. No. 5,426,455, entitled "Three Element Switched Digital Drive System For An Ink Jet Printhead", and previously incorporated by reference as if reproduced in its entirety. In this embodiment, the output sequencer 60 would provide three control lines which, when actuated by the output sequencer 60, will drive the output of the switching structure 62 to a positive, negative, or ground voltage, respectively.

More specifically, each switching structure 62 includes first and second switching elements (not shown). It is contemplated that various switching circuits, for example, bipolar or field effect transistors, are suitable for use as the switching elements. In operation, the first control line 68*a* is asserted during a first time interval to produce a positive pulse as the output at lead 28 to drive a piezoelectric sidewall actuator 34 electrically associated therewith, from a rest position, in a first direction, thereby imparting a compressive pressure pulse to a first ink-carrying channel 32 partially defined by the sidewall actuator 34 being driven by the switching structure 54 and an expansive pressure pulse to a second ink-carrying channel 32 partially defined by the sidewall actuator 34 being driven by the switching structure 54.

Next, during a second time interval, the first control line 68*a* is deasserted and the second control input line 68*b* is simultaneously asserted, thereby causing the output at lead 28 to transition from positive to negative, thereby driving the piezoelectrical sidewall actuator 34 electrically associated therewith in the opposite direction, thereby imparting a compressive pressure pulse to the second ink-carrying channel 32 partially defined by the sidewall actuator 34 being driven by the switching structure 62 and an expansive pressure pulse to the first ink-carrying channel 32 partially defined by the sidewall actuator 34 being driven by the switching structure 62. Finally, during a third time interval, the second control input line 68*b* is deasserted while the first control input line 68*a* remains deasserted. In response thereto, the output at lead 28 of the switching structure 62 will passively return to ground, thereby allowing the sidewall actuator 34 driven by the switching structure 54 to return to its rest position.

Using the drive system 7 described herein, a selected one or more of the ink receiving channels 32 may be actuated to drive a quantity of ink therein, in droplet form, outwardly through the associated ink discharge orifice(s) 24. To illustrate the operation of the drive system 7, the actuation of a representative channel 32*a* will now be described in conjunction with FIGS. 2–4. Prior to the actuation of the channel 32*a*, its horizontally opposed left and right sidewall actuators $\mathbf{34}_L$ and $\mathbf{34}_R$ are (at time To in FIG. 4) in initial, laterally undeflected (or "rest") positions indicated by solid lines in FIG. 2. To initiate the channel actuation cycle, the switching structure 62 associated with the left sidewall actuator $\mathbf{34}_L$ is operated to impose thereon a constant positive DC voltage pulse (i.e. the primary portion 51*a*) during the time interval $T_1$–$T_2$ shown in FIG. 4. Simultaneously, the switching structure 54 associated with the right sidewall actuator $\mathbf{34}_R$ is operated to impose thereon an equal constant negative DC voltage pulse during the time interval $T_1$–$T_2$. These opposite polarity DC voltage pulses transmitted to the sidewall actuators $\mathbf{34}_L$ and $\mathbf{34}_R$ outwardly deflect them away from the channel 32*a* being actuated and into the outwardly adjacent channels 32*b* and 32*c* as indicated by the dotted lines 72 in FIG. 2, thereby imparting respective compressive pressure pulses to the channels 32*b* and 32*c* and expansive pressure pulses to the channel 32*a*.

Next, at time $T_2$, the positive voltage pulse transmitted to sidewall actuator $\mathbf{34}_L$ and the corresponding negative voltage pulse on the sidewall actuator $\mathbf{34}_R$ are terminated, and the switching structure 62 is operated to simultaneously impose a constant negative DC voltage pulse (i.e. the echo portion 51*b*) on the left sidewall actuator $\mathbf{34}_L$, while imposing an equal constant positive DC voltage pulse on actuator $\mathbf{34}_R$, during the time interval $T_2$–$T_3$. These opposite polarity constant DC voltage pulses inwardly deflect the sidewall actuators $\mathbf{34}_L$ and $\mathbf{34}_R$ past their initial undeflected positions and into the channel 32*a* as indicated by the dotted lines 76 in FIG. 2, thereby simultaneously imparting respective compressive pressure pulses into the channel 32*a*. Such inward deflection of the actuators $\mathbf{34}_L$ and $\mathbf{34}_R$ reduces the volume of channel 32*a*, thereby elevating the pressure of ink therein to an extent sufficient to force a quantity of the ink, in droplet form, outwardly through the orifice 24 associated with the actuated channel 32*a*.

Returning now to FIG. 5, each control circuit 50 within the controller portion 30 of the drive system 7 includes a timing controller 52 to which clock and print enable signals are provided by the microcontroller 3. When the microcontroller 3 selects a channel 32, for example, channel 32*a*, to be actuated, the microcontroller 3 drives the print enable signal to the timing controller 52 high for first and second control circuits 50 to initiate the deflection of sidewall actuators $\mathbf{34}_L$ and $\mathbf{34}_R$. Simultaneously therewith, and as to be more fully described below, the microcontroller 3 also provides N bits of print data related to the spot size to be formed by the droplet to be ejected by the channel 32*a* selected for actuation to look-up table 54.

More specifically, the size of ink spots formed on a sheet of paper when struck by a droplet of ink will vary depending on the volume of ink contained in the droplet ejected by the selected channel 32*a*. A spot size number is assigned to each spot size which may be selected for formation on the sheet of paper. The various spot size numbers are digitally encoded by the microcontroller 3 and, when the control circuit 50 is enabled for generation of a droplet forming voltage pulse capable of forming a spot having a selected spot size, the microcontroller 3 transmits the corresponding spot size number to the look-up table 54. For example, if it is desired to select from 16 spot sizes when actuating a channel, the microcontroller 3 would provide a four bit spot size number to the look-up table 54.

As previously set forth, by applying the voltage waveform 51 having a primary portion 51*a* having a selected positive peak value and extending for a first selected time period and an echo portion 51*b* having a selected negative peak portion and extending for a second selected time period to the sidewall actuators $\mathbf{34}_L$ and $\mathbf{34}_R$ defining the channel 32*a* to be actuated, a droplet of ink will be ejected which contains a volume of ink which, when striking the sheet of paper, will form a spot having the selected spot size. In one embodiment of the invention, such spot size modulation may be achieved by selecting positive and negative peak values and varying pulse duration during which the selected peak values are applied to the sidewall actuators $\mathbf{34}_L$ and $\mathbf{34}_R$. Accordingly, in this embodiment of the invention, the look-up table 54 contains a series of entries which are used to convert the provided spot size number into a digital representation of an increment of time during which primary and echo portions 51*a*, 51*b* of the voltage waveform 51 having preselected positive and negative peaks should be generated in order to form a droplet capable of producing a spot of the selected size. For example, the digital representations stored in the look-up table may be representations of all time durations between 3 μsecond and 30 μsecond with 1 second intervals between each successive time duration. These representations may be stored in the look-up table 54, which for example, may be a RAM, ROM or other storage medium, during the power-up process for the ink jet printhead 1. It is further contemplated that the look-up table 54 may be used to calibrate the ink jet printhead 1 for optimized operation. For example, if differences in operating characteristics between printheads, for example, droplet velocity or droplet volume are observed during the testing process, the contents of the look-up table may be revised to correct for such differences. This enables the look-up table to correct for manufacturing differences between printheads. Finally, it should be noted that while, in the embodiment of the invention disclosed herein, it is contemplated that the look-up table 54 for each control circuit 50 of the ink jet printhead 2 should have identical digital representations stored therein, in many printheads, it will be necessary to vary the contents of the look-up table for various ones of the control circuits. For example, if the ink jet printhead was designed for color printing, each color of ink (cyan, magenta, yellow and black) has very different physical characteristics. Accordingly, if the ink-carrying channels dedicated to the various colors of ink are to eject equal volume droplets of ink at the same velocity, the digital representations stored in the look-up tables would most likely vary for each color of ink.

Upon receipt of the print enable signal from the microcontroller 3, and if the positional information provided by the rotary encoder 6 indicates that the drum is properly positioned so that the selected channel 32*a* will strike the paper stock at the correct line, the timing controller 52 prepares the control circuit 50 for the generation of a spot size modulatable control signal by clearing n-bit counter 56 by asserting line 52*b* high. After resetting the n-bit counter 56 in this manner, the timing controller 52 deasserts the line 52*b* while asserting lines 52*a* and 52*c* high. In response to the assertion of the line 52*c*, the n-bit counter 56 initiates a new count cycle and, in response to the assertion of the line 52*a*, the output sequencer 60 asserts control line 68*a*, thereby instructing the switching structure 62 to begin generation of the primary portion 51*a* of the voltage waveform 51.

More specifically, upon assertion of either control line 68*a* or 68*b* by the output sequencer 60, the switching structure 62 will apply either +V volts (if control line 68*a* was asserted) or −V volts (if control line 68*b* was asserted) to associated electrical actuation lead 28. As the front end of each leads 28 is individually connected to the metal layers 40 (see FIG. 2) on the undersides of the top sidewall actuator parts 34*a*, a positive or negative voltage is thusly applied to the sidewall actuator 34.

Lastly, the timing controller 52 sequences the addresses to be looked up by the look-up table 54. More specifically, the timing controller 52 informs the look-up table 54 whether a time duration for the primary portion 51*a* or the echo portion 51*b* of the voltage waveform 51 should be looked up. Here, as the timing controller 52 is initiating the application of the voltage waveform 51, the look-up table requires the time duration of the primary portion 51*a* of the voltage waveform. Accordingly, the timing controller deasserts line 52*d*, thereby informing the look-up table 54 to look up the stored time duration of the primary portion 51*a* corresponding to the provided spot size.

The look-up table 54 propagates the n bit representation of the time duration for the primary portion 51*a* of the voltage waveform 51 for the selected spot size to comparator circuit 58. There, the n-bit signal is compared to each successive n-bit count output by the n-bit counter 56. More specifically, each time that the timing controller 52 determines that a selected time interval, for example, 1 μsecond, has expired, the timing controller asserts line 52*e*, the clock input to the n-bit counter 56. In turn, the n-bit counter 56 continuously accumulates and outputs this time count via the Q output and output line 56*a* to the comparator circuit 58. When the n-bit output of the look-up table 54 matches the n-bit count output by the n-bit counter 56, the comparator circuit 58 has determined that primary portion 51*a* of the echo pulse voltage waveform 51 has been applied for the appropriate time interval. The comparator circuit 58 will then assert output line 58*a*. Upon detecting the assertion of output line 58*a*, the output sequencer 60 will deassert control line 68*a* and assert control line 68*b*, thereby causing the output of the switching structure 62 to switch from the primary portion 51*a* to the echo portion 51*b*.

The output of the comparator circuit 58 is also propagated to the timing controller 52, again via control line 58*a*. In response to the receipt thereof, the timing controller 52 will reset the n-bit counter 56 in the manner previously described, assert output line 52*d* to instruct the look-up table 54 to transmit the selected time duration for the echo portion 51*b* of the voltage waveform 51, assert output line 52*c* to initiate a time count for the echo portion 51*b* and repeatedly transmit clock pulses to the n-bit counter 56 via the output line 52*e*. As before, the look-up table 54 transmits the time duration for the echo portion 51*b* of the voltage waveform 51 for the selected spot size to the comparator circuit 58 via the output line 54*a* where it is continuously compared to the n-bit count output by the n-bit counter 56. When the n-bit output of the look-up table 54 matches the n-bit count output by the n-bit counter 56, the comparator circuit 58 has determined that echo portion 51*a* of the voltage waveform 51 has been applied for the appropriate time interval. The comparator circuit 58 will again assert output line 58*a* to instruct the output sequencer 60 to deassert the control line 68*b* which, in turn, causes the output of the switching structure 62 to return to zero, and to inform the timing controller 52 that the selected voltage waveform 51 has been generated. The timing controller 52 will then await a next print enable signal from the microcontroller 3.

Figure 6:
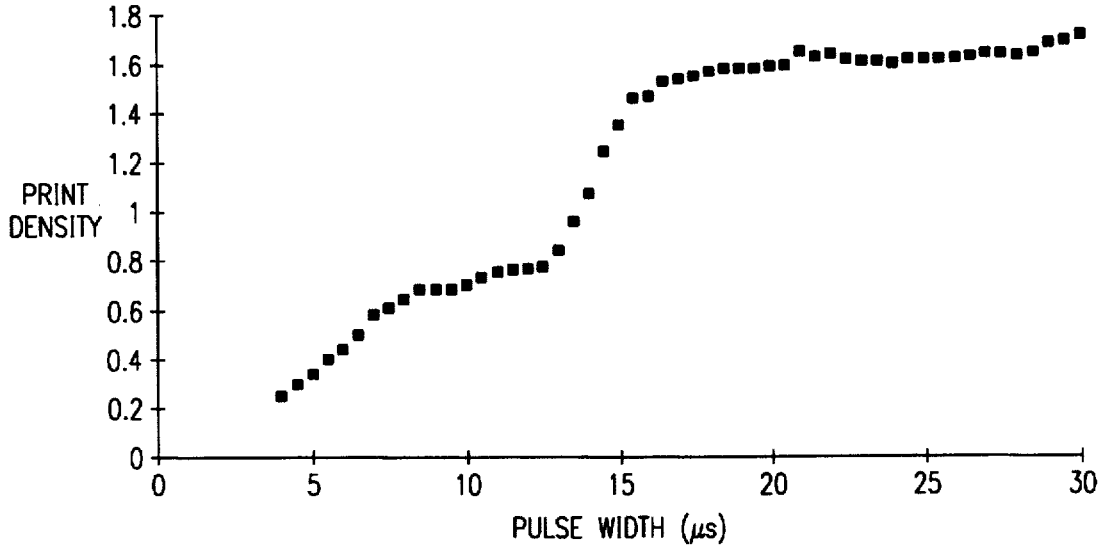
FIG. 6 is a graphical illustration of the relationship between spot size and pulse width for the voltage waveform of FIG. 4.

Referring next to FIG. 6, the relationship between spot size and pulse width for the primary and echo portions 51*a*, 51*b* of the voltage waveform 51 may now be seen. In the example illustrated herein, an ink jet printhead was fired at a frequency of 5 KHz by applying a constant voltage of 36 volts while varying the pulse width between 3 and 30 μseconds. As may now be seen, print density which, as previously described, is directly related to the size of ink spots formed on the sheet of paper by the modulatable sized droplets of ink ejected by the ink jet printhead. More specifically, the size of spots produced on the sheet of paper may be modulated by varying the pulse width of the primary and echo portions 51*a*, 51*b* of the voltage waveform 51 while maintaining the peak voltages constant.

More specifically, FIG. 6 illustrates that the spot density may be increase by a factor of 8 by varying the pulse width between 3 μsecond and 30 μsecond. Below 3 μsecond, the ink jet printhead failed to eject any ink droplets. Even more preferably, the ink jet printhead should be operated in the range of 10–30 μseconds. At pulse widths below 10 μseconds, the ejection velocity of droplets slowed to the point that alignment error producing trajectories become of concern. Above approximately 30 μseconds, on the other hand, further increases in print density were not readily achieved. In this, the preferred operating range, the spot density may be increased by a factor slightly greater than 2.

In an alternate embodiment of the invention, the control circuit 50 may be configured to modulate spot size by varying the voltage of pulses applied to the piezoelectric actuators 32 via the leads 28. To do so, the switching structure should be modified such that a selected positive voltage pulse ranging between 0 and +V volts and a selected negative voltage pulse ranging between 0 and −V volts may be output via lead 28. Also, the look-up table 54 should be modified so that the selected spot size may be translated to a voltage magnitude and transmitted to the switching structure 62 where the switching structure is reconfigured such that the positive and/or negative supply voltages may be modified to match the voltage magnitude supplied by the look-up table 54. Additionally, the look-up table should supply a pre-selected time period during which the voltage pulse is to be applied to the comparator circuit 58. For example, 30 μseconds would be a suitable constant time period.

In yet another embodiment of the invention, the controller may be configured to modulate spot size by varying the duration of a voltage waveform having a selected positive peak value and similar in shape to the primary portion 51*a* of the voltage waveform 51. To do so, the timing controller 52 should be reconfigured that each output from the comparator circuit 58 indicates that the pulse sequence for the selected voltage waveform is complete.

Thus, the present invention of a piezoelectrically actuated ink jet printhead which achieves a grey scale capability by providing for a high degree of spot size modulation by varying the duration or magnitude of voltage pulses applied to piezoelectric actuators acoustically coupled to the channels of the ink jet printhead. As individual droplets strike the substrate, they produced a generally circular shaped having the selected size. The elongation of spots, distorted images and loss of resolution, problems characteristic of systems which utilize multiple droplets to form variously sized spots on a substrate have been eliminated.

The foregoing detailed description is to be clearly understood as being given by way of illustration and example only, the spirit and scope of the present invention being limited solely by the appended claims.

What is claimed is:

1. A spot size modulatable, drop-on-demand type ink jet printhead for producing grey-scale images on a substrate, comprising:

a main body portion having an ink-carrying channel extending therethrough;

a piezoelectric actuator acoustically coupled to said ink-carrying channel;

a switching structure electrically connected with said piezoelectric actuator for selectively applying a voltage waveform to said piezoelectric actuator to cause a deflection of said piezoelectric actuator, said deflection of said piezoelectric actuator generating a pressure wave in said ink-carrying channel capable of ejecting a droplet of ink therefrom;

means for selecting a spot size for droplets ejected from said ink-carrying channel to form when striking said substrate;

a look-up table for translating said selected spot size into a time period during which said voltage waveform is to be applied; and a control circuit for causing said switching circuit to initiate application of said voltage waveform, for determining whether said voltage waveform has been applied to said piezoelectric actuator for said time period and for terminating application of said voltage waveform upon expiration of said time period;

wherein said control circuit further comprises:

sequencer means for selectively asserting or deasserting at least one control signal for output to said switching structure, said selective assertion of said at least one control signal causing said switching structure to apply said voltage waveform to said piezoelectric actuator;

timer means for instructing said sequencer means to initiate application of said voltage waveform and for determining time elapsed since initiating application of said voltage waveform; and comparator means for comparing said time period produced by said look-up table and said elapsed time determined by said timer means, said comparator means instructing said sequencer means to deassert said at least one asserted control signal when said voltage waveform has been applied for said time period.

2. A spot size modulatable, drop-on-demand type ink jet printhead according to claim 1 wherein said look-up table further comprises means for translating said selected spot size into a time period between 3 and 30 μseconds.

3. A spot size modulatable, drop-on-demand type ink jet printhead according to claim 1 wherein said switching structure further comprises:

a positive voltage source;

a negative voltage source; and means for selectively propagating a positive voltage pulse from said positive voltage source or a negative voltage pulse from said negative voltage source to said piezoelectric actuator.

4. A spot size modulatable, drop-on-demand type ink jet printhead according to claim 3 wherein said selective propagation means further comprises means for applying a positive voltage to said piezoelectric actuator for said period of time.

5. A spot size modulatable, drop-on-demand type ink jet printhead according to claim 4 wherein said positive voltage has a magnitude between 10 and 40 volts.

6. A spot size modulatable, drop-on-demand type ink jet printhead according to claim 3 wherein said selective propagation means further comprises means for applying a positive voltage to said piezoelectric actuator for a first period of time approximately equal to said time period and means for applying a negative voltage to said piezoelectric actuator for a second period of time approximately equal to said time period.

7. A spot size modulatable, drop-on-demand type ink jet printhead according to claim 6 wherein said positive voltage has a first magnitude between 10 and 40 volts and said negative voltage has a generally equal magnitude and an opposite polarity.

* * * * *

UNITED STATES PATENT AND TRADEMARK OFFICE

CERTIFICATE OF CORRECTION

PATENT NO. : 5,557,304

DATED : September 17, 1996

INVENTOR(S) : James L. Stortz

It is certified that error appears in the above-indentified patent and that said Letters Patent is hereby corrected as shown below:

Col. 4, lns 55-56, delete hard return after "of".

Col. 9, ln. 14, delete "time To", insert --time $T_0$--.

Col. 10, ln. 31, delete "1 second", insert --1 $\mu$second--.

Signed and Sealed this

Tenth Day of December, 1996

*Attest:*

*Attesting Officer*

Bruce Lehman

BRUCE LEHMAN

*Commissioner of Patents and Trademarks*